US007007939B2

(12) United States Patent
Palmer

(10) Patent No.: US 7,007,939 B2
(45) Date of Patent: Mar. 7, 2006

(54) PNEUMATIC FACE FRAME CLAMPING APPARATUS

(76) Inventor: Taylor Palmer, 1688 N. Reservoir Rd., Blanding, UT (US) 84511

( * ) Notice: Subject to any disclaimer, the term of this patent is extended or adjusted under 35 U.S.C. 154(b) by 373 days.

(21) Appl. No.: 10/190,032

(22) Filed: Jul. 3, 2002

(65) Prior Publication Data

US 2003/0057624 A1 Mar. 27, 2003

Related U.S. Application Data

(60) Provisional application No. 60/302,908, filed on Jul. 3, 2001.

(51) Int. Cl.
*B23Q 3/02* (2006.01)

(52) U.S. Cl. ..... 269/93

(58) Field of Classification Search ..... 269/91–94, 269/25, 239

See application file for complete search history.

(56) References Cited

U.S. PATENT DOCUMENTS

| | | | | |
|---|---|---|---|---|
| 1,159,573 A | | 11/1915 | Dowming | |
| 1,651,712 A | | 12/1927 | Karelius | |
| 2,761,475 A | | 9/1956 | Hayne | |
| 2,877,815 A | * | 3/1959 | Fonken | 269/9 |
| 2,973,022 A | | 2/1961 | Danielsen, Jr. et al. | |
| 2,991,669 A | * | 7/1961 | Stock | 269/154 |
| 3,807,017 A | | 4/1974 | Une et al. | |
| 3,883,128 A | | 5/1975 | Breese | |
| 4,102,374 A | * | 7/1978 | Klein | 144/346 |
| 4,819,922 A | | 4/1989 | Boike | |
| 5,649,347 A | | 7/1997 | Cattadoris | |
| 6,058,990 A | | 5/2000 | Kent | |

* cited by examiner

*Primary Examiner*—Robert C. Watson
(74) *Attorney, Agent, or Firm*—Kirton & McConkie; Michael F. Krieger

(57) ABSTRACT

The present invention features a clamping apparatus and a method for clamping a frame, such as a face frame. The apparatus comprises a framework and a clamping assembly. The framework is capable of receiving a face frame and providing the necessary support to the frame during its assembly, while the clamping assembly is used to secure the joints of the frame in place while being permanently joined. The clamping assembly comprises a stabilizer coupled to the framework, but offset a distance so as to leave a gap or space between the framework and the stabilizer, and at least one adjustable clamping arm removably inserted within the gap or space between the framework and the stabilizer. The clamping assembly also comprises a force applicator, coupled to the adjustable clamping arm, that serves to contact the joint of a face frame and clamp the frame within the clamping apparatus. The adjustable clamping arm, and corresponding force applicator coupled thereto, is capable of moving side to side or up and down within the gap in order to reach variously positioned joints on the face frame.

6 Claims, 7 Drawing Sheets

PNEUMATIC FACE FRAME CLAMPING APPARATUS

RELATED APPLICATIONS

This application claims priority to U.S. Provisional Application Ser. No. 60/302,908 filed Jul. 3, 2001 and entitled, "Pneumatic Face Frame Clamping Apparatus."

BACKGROUND

1. Field of the Invention

The present invention relates to clamps and clamping assemblies. Specifically, the present invention relates to a method and apparatus for clamping face and various other frames using an adjustable clamping assembly designed to clamp the joints of the frame during its assembly.

2. Background and Related Art

Face frames are one of several types of furniture framework pieces that require strict detail and attention when manufacturing. These frames serve an important purpose in providing the necessary support to many fixtures, furniture, and other items. Therefore, their construction must be durable and accurate. However, as these frames tend to be rather large and bulky at times, there remains a certain level of difficulty in their manufacture. In addition, due to the number, types, and sizes of pieces used to construct or assemble the frames, there are often several joints that need connecting in order to complete the assembly of the frame.

To assemble a face frame, the manufacture first gathers several pieces of wood and cuts them to the proper size. Once each piece is properly formed, the second step in the process is to drill the pocket holes at each specified location. Pocket holes are those holes that are designed and intended to accept a permanent fastener, such as a screw, which hold or secure two or more pieces of the frame together. The joining of two or more pieces together creates what is commonly referred to in the industry as a joint. It is at these joints that each of the frame pieces are securely fastened together to create the finished assembled face frame.

After the pocket holes are drilled, using any known means in the art, the next step in assembling the face frame is to align the pieces in their correct position and glue them together at the joints. This provides a temporary assembly of the frame pieces and allows the manufacturer to prepare the face frame for permanent assembly using one or more types of fasteners. Typically, screws are the preferred choice as they are easy to insert using a power drill. The fasteners are inserted through the pocket holes and set into place to securely join together, at the joints, the several face frame pieces in a permanent fashion to create the assembled face frame.

While seemingly simple, the assembly of the several pieces of the face frame in a permanent manner is difficult and, as stated, requires a great amount of attention. As each piece must be accurately aligned so as to not create unsightly ridges or multi-planar surfaces, it becomes difficult to secure the pieces in place while inserting the fasteners into the joint. This difficulty increases as the manufacturer must maintain the correct alignment of the pieces as the fastener is inserted into the joint. As a result of the pressure or force exerted upon the joint, there is a tendency for one or both of the pieces to slip out of alignment, thus creating a faulty joint. As such, it becomes critical to be able to properly align and join two or more pieces of the face frame together during the manufacturing or assembly process to create a properly formed joint. This is typically done by using some type of clamping assembly to hold the joints together while the fastener is inserted through the pocket holes.

Many prior art methods and devices exist serving to assist the contractor or manufacturer in the assembly of these wood and other frames. One rather simplified method is to obtain a c-clamp or similar clamping device and place one at each of the joints that need to be assembled. However, these clamps are not capable of providing the securing force necessary to maintain an accurate joint. In addition, these clamps are incapable of securing in place the entire frame, have a tendency to loosen, and can potentially cause unsightly marks in the face frame itself at the contact points. In addition, using these types of clamping devices are intrusive, thus making it difficult for the manufacturer to work around.

Other, more elaborate, clamping devices exist which serve to secure the joint of the face frame during its assembly. These devices are capable of accepting the face frames and clamping the joints of the face frames during construction. The clamping assemblies used by these devices commonly utilize one or more pneumatic or hydraulic piston cylinder or rams which causes a ram to exert a substantial amount of force upon the face frame at the joint area. This force holds the joint in proper alignment while the manufacturer installs the fastener (e.g. screw) into the joint. However, these devices require the manufacturer to manipulate and position the face frame joint by joint as the clamping assembly is fixed and incapable of moving or being adjusted. Thus, the entire face frame must be brought into position joint by joint so that the clamping assembly can secure each joint while the manufacturer installs the necessary fasteners. This is a labor intensive process and increases the manufacturing costs of the face frames. In addition, these clamping devices tend to be expensive themselves.

SUMMARY AND OBJECTS OF THE INVENTION

In light of the apparent, as well as inherent, difficulties associated with the prior art face frame assembling methods and devices discussed above, the present invention seeks to provide a more amicable solution to the need to more effectively and efficiently assemble face frames and other types of frames, such as picture frames.

Therefore, it is an object of the preferred embodiments of the present invention to provide a method and apparatus for clamping, wherein the apparatus is capable of clamping the joints of a frame member, and various other items, during its assembly.

It is another object of the preferred embodiments of the present invention to provide a method and apparatus for clamping, wherein the apparatus comprises one or more adjustable clamping assemblies that allow a manufacturer to manipulate and position the clamping assemblies at various locations around the frame member.

It is still another object of the preferred embodiments of the present invention to provide a method and apparatus for clamping, and particularly, method and apparatus for clamping a face frame.

It is a further object of the preferred embodiments of the present invention to provide a method and apparatus for clamping the joints of a face frame, wherein the apparatus can accommodate different sized and odd shaped face frames.

It is still a further object of the preferred embodiments of the present invention to provide a method and apparatus for clamping, wherein the apparatus utilizes at least one, or a series of, pneumatic piston cylinders, which provide the necessary clamping force.

To achieve the foregoing objects, and in accordance with the invention as embodied and broadly described herein, the present invention features a clamping apparatus and a method for clamping a work piece, such as a frame, a face frame, a picture frame, etc. The apparatus comprises a primary support framework and a clamping assembly. The primary support framework is capable of receiving the work piece, preferably a face frame, and providing the necessary support to the face frame during its assembly. A working surface is included on the primary support framework wherein the face frame may be laid while its joints are clamped for assembly. In addition, a back support and corresponding back board may also be present and coupled to the primary support framework in order to provide lateral support to the face frame while in the clamping apparatus.

The clamping assembly comprises a stabilizer coupled to the primary support framework, but offset a distance so as to leave a gap or space between the framework and the stabilizer, and at least one adjustable clamping arm removably inserted within the gap or space between the framework and the stabilizer. The clamping assembly also comprises a force applicator, coupled to the adjustable clamping arm, that serves to contact a portion of the face frame, preferably the joint portion, and clamp the frame within the clamping apparatus. In a preferred embodiment, the force applicator is a pneumatic piston cylinder having a ram that extends therefrom for contacting and clamping the face frame. Alternatively, the force applicator may be comprised of a hydraulic system, an electric system, or an electromechanical system, each serving to contact the joint of a face frame and clamp the face frame within the clamping apparatus.

The adjustable clamping arm, and corresponding force applicator coupled thereto, is capable of moving side to side or up and down within the gap in order to reach variously positioned joints on the face frame. This adjustability is discussed in greater detail below. As a frame, or face frame, is brought to rest within the clamping apparatus for assembly, the adjustable clamping arm(s) is/are brought into position over the joints in the face frame. Once in place, the force applicator, (e.g. pneumatic piston cylinder), is activated, thus providing a contact on the face frame. The force applicator preferably provides varying pressure levels, and as the force is increased, the adjustable arm becomes temporarily wedged in place between the stabilizer and the framework as a result of the force applied to the face frame from the force applicator, thus clamping the face frame in place. At this time, the joints may be permanently assembled by fastening together the two or more pieces of the frame that make up the joint because the joint is securely clamped in place. This is typically done using screws or other means. Once the screws are inserted, the force applicator is deactivated and a subsequent joint moved into place where it may be clamped and permanently joined. This process is repeated until all the pieces in the face frame have been securely and permanently joined.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE PREFERRED EMBODIMENTS

It will be readily understood that the components of the present invention, as generally described and illustrated in the figures herein, could be arranged and designed in a wide variety of different configurations. Thus, the following more detailed description of the embodiments of the system and method of the present invention, and represented in FIGS. 1 through 7, is not intended to limit the scope of the invention, as claimed, but is merely representative of the presently preferred embodiments of the invention.

The presently preferred embodiments of the invention will be best understood by reference to the drawings wherein like parts are designated by like numerals throughout.

The present invention describes a method and apparatus for clamping, and particularly, a method and apparatus for clamping the joints of a work piece, face frame, or similar assembly, such as picture frames and other suitable furniture or decorative pieces.

Figure 1:
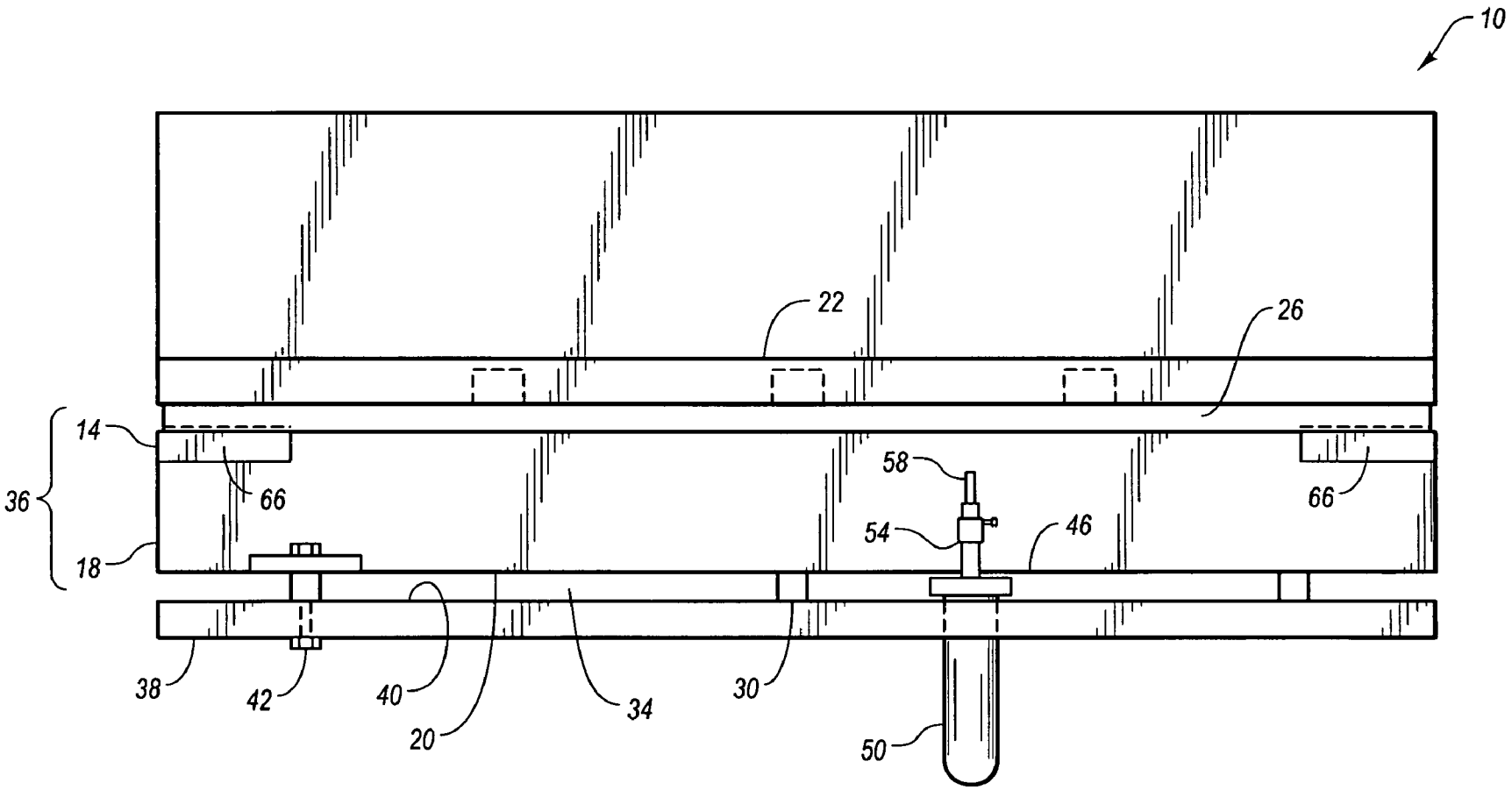
FIG. 1 illustrates a top view, shown at a ten degree angle, of the clamping apparatus according to the present invention, and particularly the clamping assembly comprising the adjustable clamping aims as contained within the gap space created by the offset stabilizer and the working surface, and the force applicators coupled to the adjustable clamping arms.

FIG. 1 is illustrative of the clamping apparatus as seen from the top and at a 10 degree angle. Clamping apparatus 10 is shown to comprise a support primary support framework 14 and a clamping assembly 36. Support primary support framework 14 includes working surface 18 whereon a frame, such as a face frame, may be placed or rested during its assembly. Working surface 18 comprises a substantially flat, horizontal surface and is shown in FIG. 1 as being approximately 6 inches in width and 49 inches in length. Extending substantially perpendicular to working surface 18 are back supports 22. Back supports 22 are rigid members that protrude or extend in an upward direction from working surface 18 so as to be able to accept a removable back board 26 that typically consists of panel board or another suitable flat material, such as ply wood, etc. Removable back board 26 serves to provide lateral support to a frame that has been inserted into the clamping apparatus 10. Removable back board 26 also serves to counteract the force applied by a force applicator 50, which will be discussed in greater detail below. Essentially, once the pocket holes on a face frame are drilled in their appropriate positions and each of the pieces that exist to make up the face frame are glued together, the temporarily assembled face frame may be inserted into clamping apparatus 10 and prepared for permanent assembly. The purpose of clamping apparatus 10 is to secure in place each of the joints that are to be permanently joined together using a fastener, such as a screw. It should be noted that primary support framework 14 may exist in various sizes and shapes in order to accommodate the different types of frames and other project pieces. As such, the configuration shown in the drawings and described herein is intended to be an example only and is not meant to be limiting in any way.

FIG. 1 also illustrates clamping assembly 36 and its various components. Specifically, clamping assembly 36 comprises a stabilizer 38 that is coupled to primary support framework 14 and particularly working surface 18 so that the tops of each piece are substantially flush with one another. Stabilizer 38 may be coupled to primary support framework 14 using any known means in the art. In any even, stabilizer 38 is coupled to primary support framework 14 at an offset distance from primary support framework 14 and particularly working surface 18 so as to create a gap or space 34 between working surface 18 and stabilizer 38. In FIG. 1, this gap 34 is shown as being 1 1/16 inches wide, but may be any size suitable of receiving or accepting an adjustable clamping arm 46 as described further below. To maintain a constant gap width between stabilizer 38 and working surface 18, a plurality of spacers 30 may be inserted or placed within gap 34.

Gap 34 is dimensioned so as to be able to receive one or more adjustable clamping arms 46. Adjustable clamping arm 46 is better shown in FIGS. 2 and 3, while FIG. 1 provides a more illustrative view of gap 34. As stated, a unique aspect of the present invention is the ability of adjustable clamping arm 46 to freely move within gap 34 so as to allow clamping assembly 36 to be adjustable. By freely moveable, it is meant that adjustable clamping arm 36 is capable of moving side to side, up and down, and even rotated as desired to properly engage a desired portion of the work piece. Once in place, it is held there by the force exerted on the work piece by force applicator 50, which results in adjustable clamping arm being wedged within the gap.

As adjustable clamping arm 46 has coupled thereto a force applicator 50, shown in each of the figures as a pneumatic piston cylinder or air cylinder, the ability for adjustable clamping arm 46 to be able to move within gap 34 becomes an important feature of the present invention as force applicator or pneumatic piston cylinder 50 comprises a ram 54 having a contact head 58 thereon, which is used to securely clamp a joint 4 located on face frame 2. Force applicator 50 is shown as a pneumatic piston cylinder, but may also be a hydraulic pump or system, an electric pump or system, or an electromechanical pump or system. One ordinarily skilled in the art will recognize the different types of devices and assemblies that may be used to accomplish the objects and goals of the present invention.

Specifically, as face frame 2 is inserted into clamping apparatus 10, the adjustability of clamping assembly 36 allows the worker or manufacturer to position and manipulate adjustable clamp arm 46, with its coupled force applicator 50 and contact head 58, to come in contact with joint 4 located on face frame 2. Adjustable clamp arm 46 is capable of moving side to side, up and down, or even rotating in order to accommodate variously positioned joints located on a particular face frame as inserted into clamping apparatus 10. This provides a significant advantage over prior art face frame clamps in that the worker or manufacturer is not required to manipulate the face frame itself to fit within the clamp. Rather, the present invention allows the worker or manufacturer to instead manipulate clamping assembly 36 itself to reach the one or more joints making up the face frame.

Figure 3:
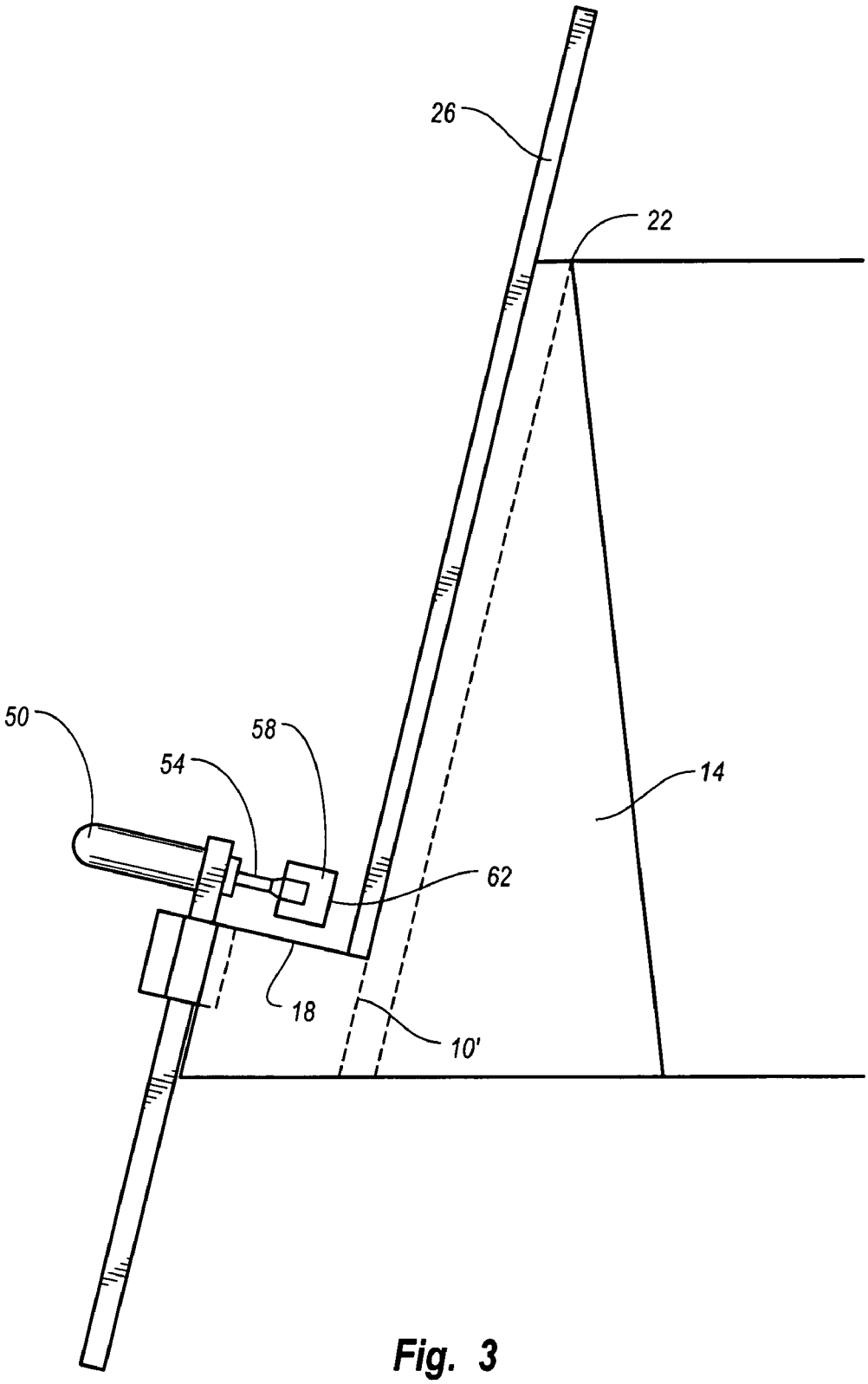
FIG. 3 illustrates a side view of the clamping apparatus showing the framework and associated clamping assembly according to the present invention.
Figure 4:
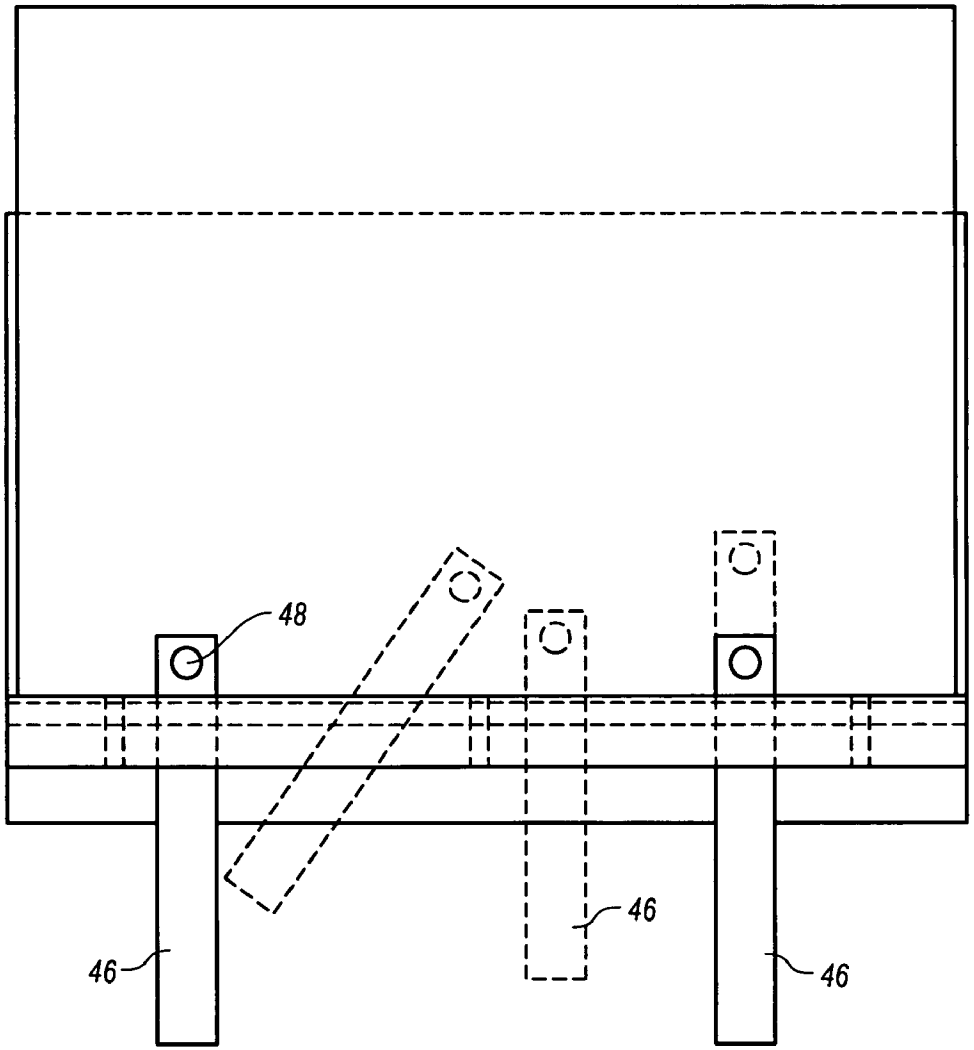
FIG. 4 illustrates a front view of the clamping apparatus, and particularly the adjustable clamping arms, stabilizer, and removable back board.

FIG. 4 illustrates the various ways in which adjustable clamping arm 46 may be manipulated by the manufacturer or worker to accommodate a face frame having several joints, which are positioned at different locations around the face frame. Specifically, adjustable clamping arm 46 is capable, as stated, as moving side to side, up and down, or even rotating at a given degree in order to match up with a given joint. This adjustability allows the worker or manufacturer to easily adjust clamping assembly 36 to fit the joints of a face frame rather than having to bring each joint of the face frame into alignment with a fixed clamping assembly, as is typically done in prior art assemblies. As shown in FIGS. 1 and 3, adjustable clamping arm 46 is comprised of 1 inch by 3 inch steel tubing. In addition, as previously stated, gap 34 comprises a space approximately 1 1/16 inch wide. As such, gap 34 is capable of receiving one or more adjustable clamp arms 46 therein. Once inserted, adjustable clamp arm 46 may freely move in any direction needed by the worker or manufacturer to align the force applicator 50 in corresponding contact head 58 with a joint 4 on face frame 2. The configuration as shown in the drawings and described herein is intended merely for illustrative purposes only, and is not meant to be limiting in any way, as one ordinarily skilled in the art will recognize possible other types of similar configurations in the spirit of the present invention.

Figure 2:
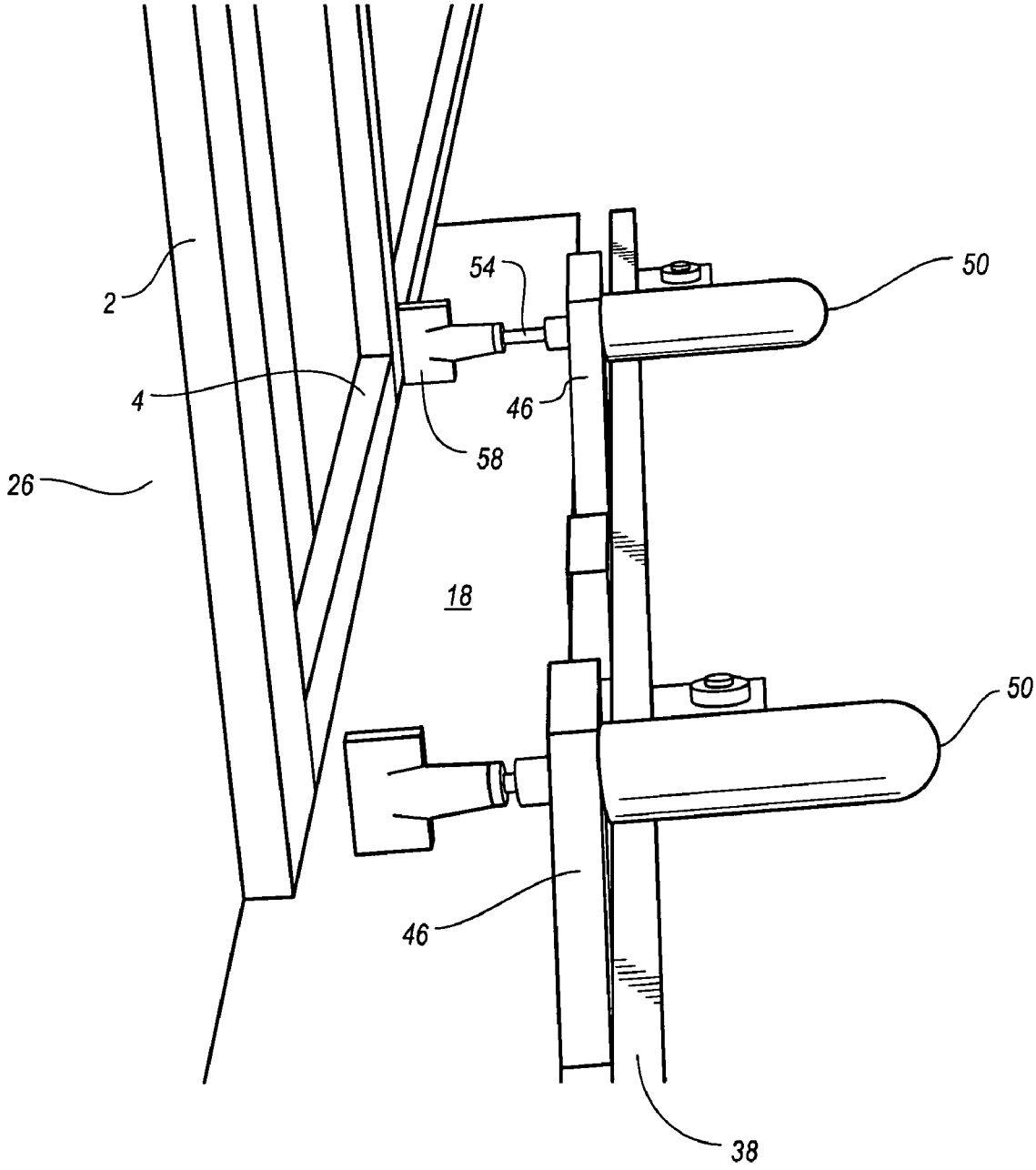
FIG. 2 illustrates the clamping apparatus according to the present invention as it clamps the joints of a face frame.

FIG. 2 is illustrative of clamping assembly 36 in its activated or clamping position. Specifically, face frame 2, having one or more joints 4 located thereon, is inserted into clamping apparatus 10 and brought to rest upon working surface 18. As stated, working surface 18 is a flat or substantially flat surface whereon a frame or other project member may lie. Once face frame 2 is in place and a joint is chosen to be secured within clamping assembly 36, adjustable clamp-on 46 is manipulated into a position aligning it with the appropriate joint to be clamped by sliding, rotating, or moving up and down adjustable clamp arm 46 to achieve the proper position. At this time, force applicator 50, shown in FIG. 2 as a pneumatic piston cylinder, is activated such that ram 54 and contact head 58 are extended to come in contact with the joint 4 of face frame 2. As contact is made, a force is exerted on face frame 2 such that face frame 2 is pinned against back board 26 thereby causing a resulting force, which causes adjustable clamping arm 46 to become wedged within gap 34 between working surface 18 and stabilizer 38. The counteracting forces present allow joint 4 to be securely clamped within clamping assembly 36, such that the worker or manufacturer may then proceed to insert the necessary fasteners to complete permanent assembly of a joint. Once the necessary fasteners are in place and the joint is permanently assembled, force applicator 50 may be deactivated causing ram 54 and corresponding head 58 to retract, thus freeing face frame 2. At the same time, as force applicator 50 is deactivated, adjustable clamping arm 46 is also freed as there no longer exists opposing forces to cause adjustable clamping arm 46 to become wedged within gap 34. This procedure or method is repeated until each joint or position in face frame 2 is permanently assembled. It should be noted that one or several joints may be clamped simultaneously, using multiple adjustable clamping arms and corresponding force applicators, in order to complete assembly of face frame 2.

Figure 5:
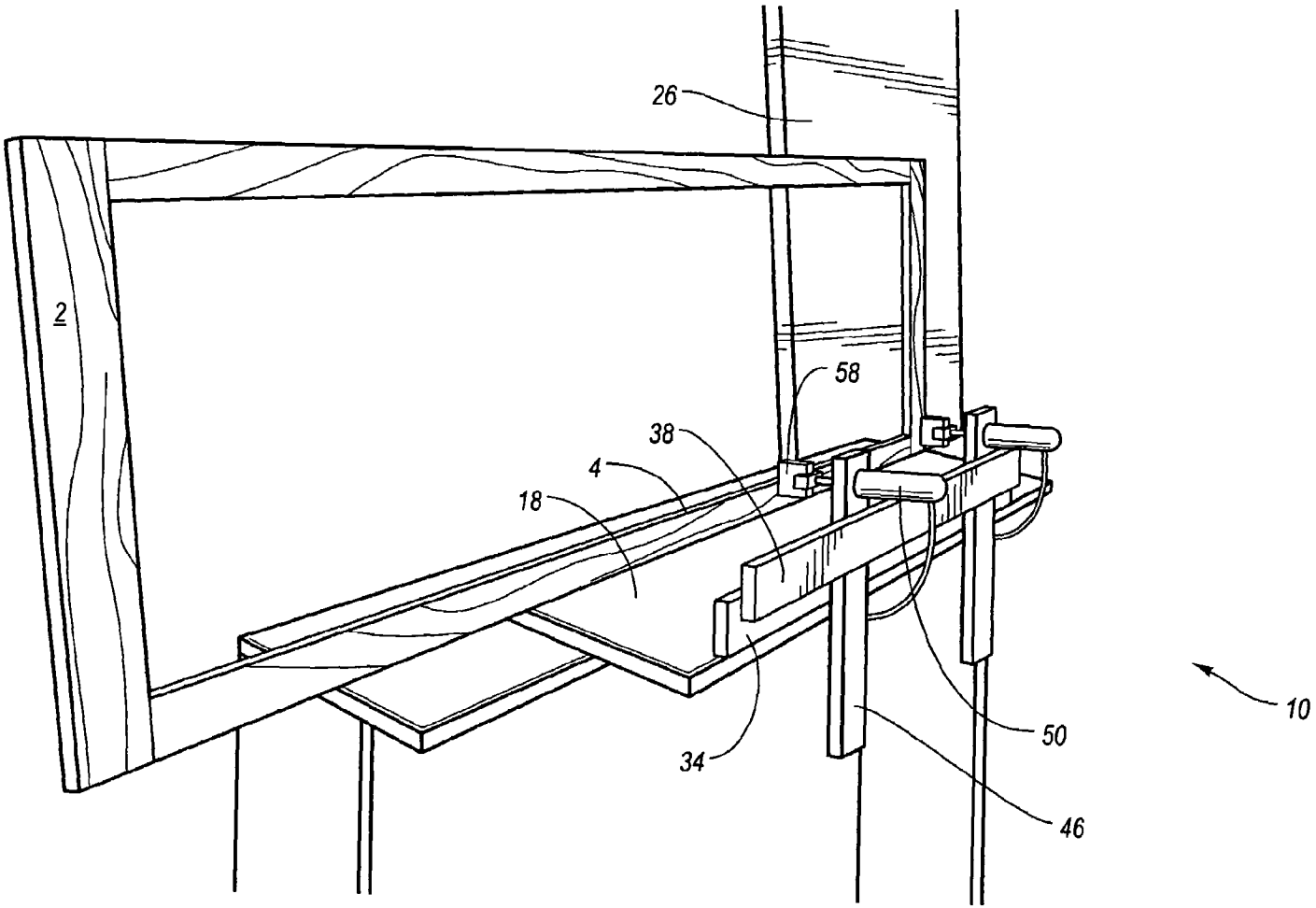
FIG. 5 illustrates a nearly assembled face frame as contained within the clamping apparatus according to the present invention.

FIG. 5 is illustrative of clamping apparatus 10 comprising two adjustable clamp arms 46, which work simultaneously to clamp two different joints 4 located on face frame 2. As shown, face frame 2 can be rather large and bulky. Having the ability to manipulate and position the necessary components in clamping assembly 36 greatly increases the efficiency of the worker or manufacturer in permanently assembling face frame 2. As face frame 2 is located or rested upon working surface 18, each of the force applicators 50 are brought to position by sliding adjustable clamp arm 46 within gap 34 so as to align them with each of the respective joints. Once aligned, each of the force applicators 50 may be activated thereby causing contact head 58 to secure joint 4 and the resulting entire face frame 2 against removable back board 26.

Figure 6:
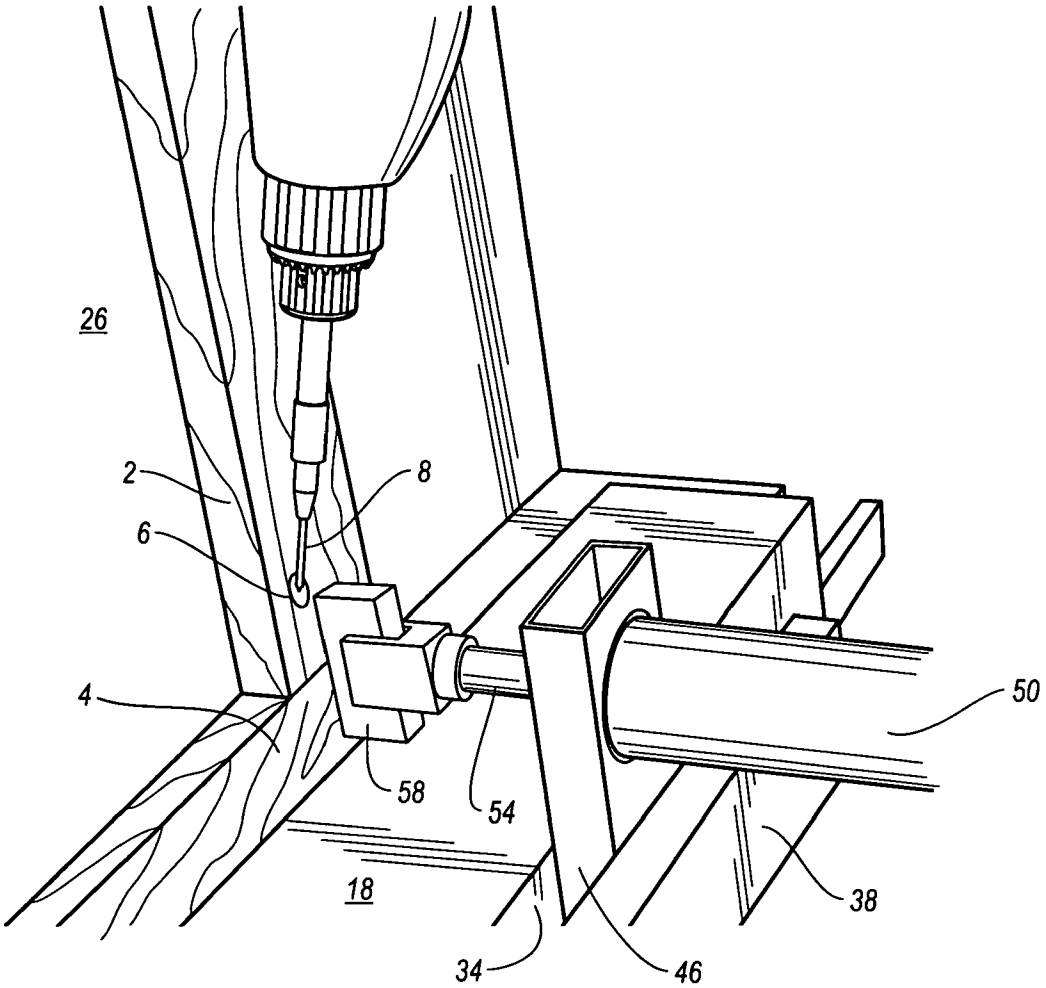
FIG. 6 illustrates a detailed view of the clamping assembly according to the present invention, and particularly, the force applicator as it is applied to the joint of a face frame.

FIG. 6 shows a detailed view of clamping assembly 36, wherein adjustable clamping arm 46, with its attached force applicator 50, is securing a joint 4 of face frame 2. As can be seen, pocket holes 6 have been previously drilled and are ready to accept fastener or screw 8. As force applicator 50 is activated, ram 54 and corresponding contact head 58 extend to apply the necessary force to joint 4 and face frame 2 so as to secure face frame 2 against removable back board 26. As a result, each piece making up joint 4 is secured and incapable of moving so that fastener or screw 8 may be inserted correctly and face frame 2 correctly assembled. This is critical as each of the joints must be properly aligned in order to obtain a well-crafted and accurately assembly face frame. Stabilizer 38 provides the necessary backing in order to secure adjustable clamping arm 46 in place once force applicator 50 is activated. To release the face frame 2 and free adjustable clamp arm 46 so that it may again become adjustable, the worker or manufacturer simply deactivates force applicator 50.

Figure 7:
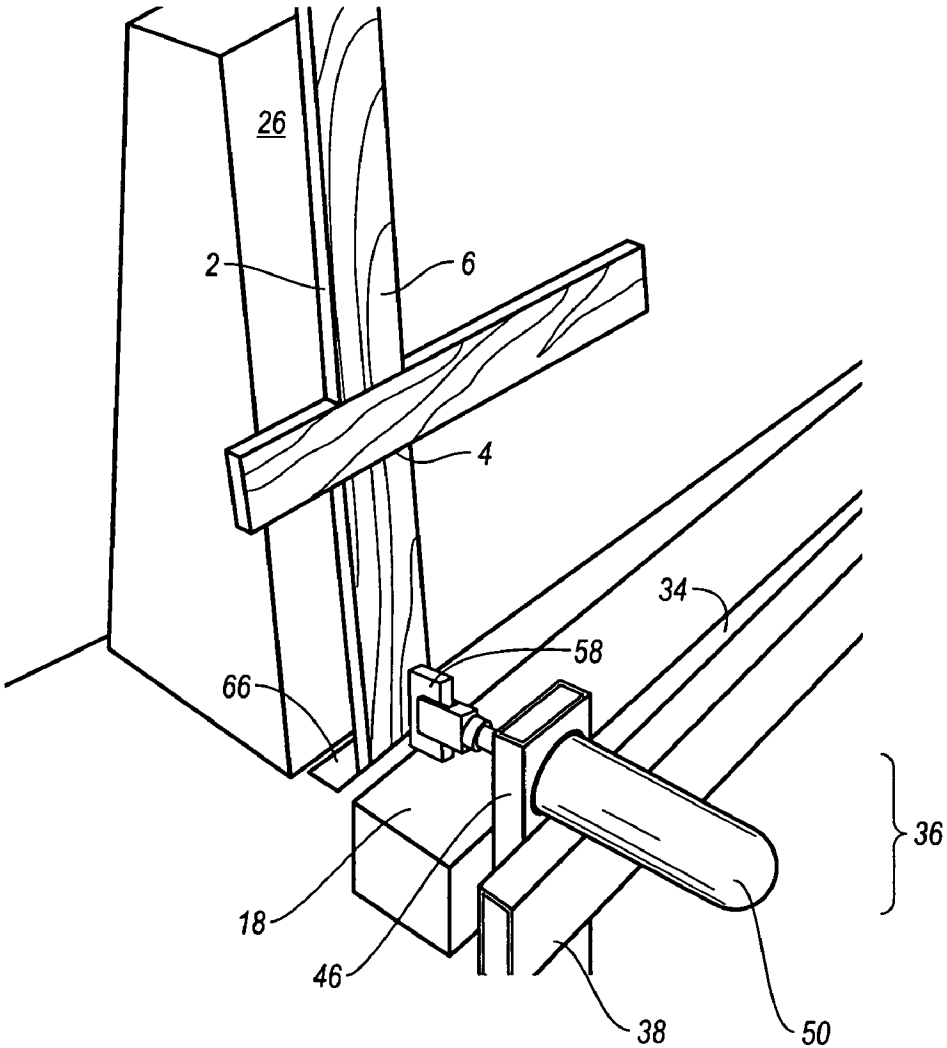
FIG. 7 illustrates one embodiment of the clamping apparatus, wherein a slotted portion is provided for that allows portions of the frame to be inserted so as to accommodate odd sizes and shapes and to bring the joints within reach of the clamping assembly during construction of the frame.

FIG. 7 is illustrative of another feature of the present invention. As shown, working surface 18 includes a slotted portion 66, which is essentially an aperture capable of accepting various odd pieces and sizes of face frame 2. As shown, one piece of face frame 2 is inserted into slotted portion 66 in order to allow joint 4 to come within the reach of clamping assembly 36 and particularly within the reach of adjustable clamp arm 46 with coupled force applicator 50. By providing a slotted portion 66 within working surface 18, an otherwise unreachable joint 4 may be brought within clamping assembly 36 so that the worker or manufacturer is not required to come up with some other method or means of permanently assembling joint 4.

The present invention further features a method for assembling a face frame comprising the steps of: (a) obtaining a frame or other project member, wherein the frame includes at least two members temporarily joined together to create a joint; (b) inserting the frame into a clamping apparatus, the clamping apparatus comprising: a support framework comprising a working surface and a series of back supports extending substantially perpendicular to the working surface for supporting the face frame; and a clamping assembly, the clamping assembly comprising: a stabilizer attached to the framework and offset a distance so as to create a gap between the working surface and the stabilizer; an adjustable clamping arm removably insertable within the gap; and a force applicator coupled to the adjustable clamping arm for providing the clamping force necessary to secure the joint on the face frame; (c) manipulating the adjustable clamping arm to align with the joint on the face frame; (d) activating the force applicator to secure the joint and the adjustable clamping arm in place; (e) inserting one or more fasteners into the secured joint to permanently join together the pieces comprising the joint; and (f) deactivating the force applicator to free the joint and the face frame as well as the adjustable clamping arm.

This method may be repeated as often as necessary to permanently join multiple joints on a face frame and to complete assembly of the face frame.

The present invention may be embodied in other specific forms without departing from its spirit of essential characteristics. The described embodiments are to be considered in all respects only al illustrative and not restrictive. The scope of the invention is, therefore, indicated by the appended claims, rather than by the foregoing description. All changes which come within the meaning and range of equivalency of the claims are to be embraced within their scope.

The invention claimed is:

1. A clamping apparatus comprising:

(a) a primary support framework capable of accepting a work piece, wherein said primary support framework further comprises a substantially horizontal working surface, and wherein said primary support framework further comprises at least one back support and corresponding back board extending from said working surface to provide additional lateral and stabilizing support to said work piece; and (b) a clamping assembly coupled to said primary support framework and comprising:

a stabilizer coupled to said primary support framework at an offset distance so as to create a gap between said primary support framework and an edge of said stabilizer;

at least one adjustable clamping arm removably insertable and freely moveable within said gap, said adjustable clamping arm capable of being tightly wedged within said gap at a desired position; and at least one force applicator coupled to said adjustable clamping arm, said force applicator applies a force to and engages a portion of said work piece to secure said work piece into position, said force applicator and said adjustable clamping arm held into position by a force exerted on said work piece and said wedging of said adjustable clamping arm in said gap as a result of said force.

2. The clamping apparatus of claim 1, wherein said force applicator comprises a pneumatic piston cylinder having a ram that extends therefrom for contacting and clamping said work piece.

3. The clamping apparatus of claim 1, wherein said adjustable clamping arm allows for multi-directional movement within said gap to position said adjustable clamping arm as desired.

4. The clamping apparatus of claim 1, wherein said stabilizer is offset from said primary support framework using a plurality of spacers positioned between said stabilizer and said primary support framework.

5. A clamping apparatus comprising:

(a) a primary support framework capable of accepting a work piece, wherein said primary support framework further comprises a substantially horizontal working surface, and wherein said primary support framework further comprises at least one back support and corresponding back board extending from said working surface to provide additional lateral and stabilizing support to said work piece, and wherein said back support is used to counteract said force, thus securing said work piece in position; and (b) a clamping assembly coupled to said primary support framework and comprising:

a stabilizer coupled to said primary support framework at an offset distance so as to create a gap between said primary support framework and an edge of said stabilizer;

at least one adjustable clamping arm removably insertable and freely moveable within said gap, said adjustable clamping arm capable of being tightly wedged within said gap at a desired position; and at least one force applicator coupled to said adjustable clamping arm, said force applicator applies a force to and engages a portion of said work piece to secure said work piece into position, said force applicator and said adjustable clamping arm held into position by a force exerted on said work piece and said wedging of said adjustable clamping arm in said gap as a result of said force.

6. A clamping apparatus comprising:

(a) a primary support framework capable of accepting a work piece, wherein said primary support framework comprises one or more slotted portions therein that accept and receive a portion of said working piece therein to allow said joint to come within reach of said clamping assembly, and particularly within reach of said adjustable clamping arm and force applicator; and (b) a clamping assembly coupled to said primary support framework and comprising:

a stabilizer coupled to said primary support framework at an offset distance so as to create a gap between said primary support framework and an edge of said stabilizer;

at least one adjustable clamping arm removably insertable and freely moveable within said gap, said adjustable clamping arm capable of being tightly wedged within said gap at a desired position; and at least one force applicator coupled to said adjustable clamping arm, said force applicator applies a force to and engages a portion of said work piece to secure said work piece into position, said force applicator and said adjustable clamping arm held into position by a force exerted on said work piece and said wedging of said adjustable clamping arm in said gap as a result of said force.

* * * * *